US009916743B2

(12) United States Patent
Harrison

(10) Patent No.: US 9,916,743 B2
(45) Date of Patent: Mar. 13, 2018

(54) SECURITY DEVICES

(71) Applicant: Guardfreight Worldwide Limited, Birmingham (GB)

(72) Inventor: Andrew Harrison, Shropshire (GB)

(73) Assignee: Guardfreight Worldwide Limited, Birmingham (GB)

( * ) Notice: Subject to any disclaimer, the term of this patent is extended or adjusted under 35 U.S.C. 154(b) by 236 days.

(21) Appl. No.: 14/436,698

(22) PCT Filed: Oct. 17, 2013

(86) PCT No.: PCT/GB2013/052709
§ 371 (c)(1),
(2) Date: Apr. 17, 2015

(87) PCT Pub. No.: WO2014/060757
PCT Pub. Date: Apr. 24, 2014

(65) Prior Publication Data

US 2015/0287297 A1 Oct. 8, 2015

(30) Foreign Application Priority Data

Oct. 17, 2012 (GB) ..... 1218647.4

(51) Int. Cl.
*G08B 13/08* (2006.01)
*E05B 83/10* (2014.01)
(Continued)

(52) U.S. Cl.
CPC ..... *G08B 13/08* (2013.01); *E05B 13/002* (2013.01); *E05B 39/005* (2013.01); *E05B 83/10* (2013.01);
(Continued)

(58) Field of Classification Search
CPC .... G08B 13/08; G08B 13/183; G08B 13/126; G08B 13/186; E05B 39/005; E05B 13/002; E05B 83/10; E05C 19/186
See application file for complete search history.

(56) References Cited

U.S. PATENT DOCUMENTS 4,095,872 A 6/1978 Stieff et al.
5,775,747 A 7/1998 Navarsky
(Continued)

FOREIGN PATENT DOCUMENTS

FR 2893655 A1 5/2007
WO 2008017841 A1 2/2008
(Continued)

OTHER PUBLICATIONS

International Search Report for PCT/GB2013/052709.
Search Report for GB Application No. 1218647.4.

*Primary Examiner* — Brian Wilson
(74) *Attorney, Agent, or Firm* — Fox Rothschild LLP

(57) ABSTRACT

A monitoring device arranged to be fitted to a door, wherein the door includes an operating bar mounted on the door for angular movement about its axis and a handle which is connected to the operating bar by a pivotal connection; wherein the device comprises a body element and a cover element arranged to slide relative to the body element and the two elements having a closed configuration and an open configuration in which the cover element is extended relative to the body element thereby allowing the device to be fitted to a door; the body and cover elements being shaped so that when in the closed configuration a pocket is formed that substantially surrounds an operating bar and further wherein the cover element comprises a portion extending over a region of a handle of a door to which the device is fitted such that that handle is prevented from rotating
(Continued)

relative to the door; and monitoring circuitry arranged to monitor the device.

14 Claims, 12 Drawing Sheets

(51) Int. Cl.

| | |
|---|---|
| ***G08B 13/12*** | (2006.01) |
| ***E05B 39/00*** | (2006.01) |
| ***E05C 19/18*** | (2006.01) |
| ***E05B 13/00*** | (2006.01) |
| ***G08B 13/183*** | (2006.01) |
| *G08B 13/186* | (2006.01) |

(52) U.S. Cl.
CPC ..... *E05C 19/186* (2013.01); *G08B 13/126* (2013.01); *G08B 13/183* (2013.01); *G08B 13/186* (2013.01)

(56) References Cited

U.S. PATENT DOCUMENTS

| | | | | |
|---|---|---|---|---|
| 5,791,702 | A | 8/1998 | Liroff | |
| 8,011,213 | B1 | 9/2011 | Gogel | |
| 2010/0170310 | A1* | 7/2010 | Ivashin ..... | E05B 39/025 70/91 |

FOREIGN PATENT DOCUMENTS

| | | | |
|---|---|---|---|
| WO | 2010151898 | A1 | 12/2010 |
| WO | 2012038758 | A1 | 3/2012 |

* cited by examiner

SECURITY DEVICES

CROSS REFERENCE TO RELATED APPLICATION

This application is the U.S. National Phase of International Application No. PCT/GB2013/052709, filed Oct. 17, 2013, which claims the benefit of GB Application no. 1218647.4 filed Oct. 17, 2012, the disclosures of which are incorporated herein by reference in their entireties.

FIELD OF THE INVENTION

Inventions described herein relate to devices arranged to improve the security of freight, cargo and the like as well as improving the recovery of the devices. In particular some aspects relate to devices arranged to be used with ISO freight containers. Other aspects may be used more generally with other types of freight and cargo. Some aspects of the invention provide a monitoring device arranged to monitor the condition of cargo, such as an ISO freight container.

BACKGROUND OF THE INVENTION

Security during transportation of freight is an important consideration. It is known to secure ISO freight containers with security seals but these do not provide the security that might be desired.

ISO freight containers and other cargo may pass through the control of many different parties. However, responsibility of for the contents of the freight container lies with the party that sealed that container. Accordingly, that party sealing the container needs to be confident that the container, or other cargo, cannot be accessed. Current security seals do not give this level of knowledge. Thus, a market has developed for secondary security devices that can be fitted for the whole or part of a journey to add further security.

If a security device is to be used for only a portion of the cargo's journey then it may need to be fitted to a freight container that has already been sealed with an ISO seal. Some prior art security devices, such as WO2008/017841, uses apertures intended for security seals and accordingly is not suitable for securing a freight container or other cargo for only part of its journey.

Typically prior art devices, including that shown in U.S. Pat. No. 5,775,747, try to physically prevent opening of a container, such as an ISO freight container, to which they are fitted. Trying to prevent opening does not provide the confidence needed that the contents of a freight container to which the device has been fitted have not been accessed. Parties involved in nefarious activity have developed a significant array of techniques to gain access to containers without the need to operate the operating bars, etc. or to remove locks and refit them.

It can also be a problem to recover a security device that has been used to secure a freight container or other cargo since the security device will finish its journey somewhere remote from where it needs to be used again.

SUMMARY OF THE INVENTION

According to a first aspect of the invention there is provided a monitoring device for a door. The door will typically include an upright operating bar mounted on the door for angular movement about its axis and a handle which is connected to the operating bar by a pivotal connection.

The device may comprises a body element and a cover element arranged to slide relative to the body element. In one embodiment, the two elements have a closed configuration and an open configuration in which the cover element is extended relative to the body element. Conveniently, the open configuration allows the security device to be fitted to a door.

Conveniently, the body and cover elements are shaped so that when in the closed configuration a pocket is formed that substantially surrounds an operating bar. The cover element may further comprise a portion that extends over a region of a handle of a door to which the device is fitted such that that handle is prevented from rotating relative to the door.

Embodiments providing such a monitoring device are believed advantageous because they can be fitted to a freight container, which might be an ISO freight container, whilst the freight container has already been sealed. Moreover, the pocket that is formed by the cover and body elements provides a secure mechanism to secure the monitoring device to a single operating bar.

Conveniently, the device further comprises monitoring circuitry arranged to perform at least one of:

i) monitoring the relative condition of the body and cover elements; and ii) monitoring the presence of an activation bar to which in use the device is fitted;

and wherein the device is arranged to generate an alarm should monitoring circuitry detect a change in the monitored condition.

Embodiments having such monitoring devices are believed advantageous since they can generate an alarm should the monitoring device be tampered with. Accordingly, if an attempt is made to physically defeat the device then that activity should be noted and the risk that access has been obtained to the contents of the container to which the device has been fitted should be noted.

In one embodiment, the body element comprises a U shaped portion arranged to provide a part of the pocket which is arranged to receive the operating bar. The cover element may also comprise a U shaped portion.

Conveniently, in embodiments in which the cover and body elements have U shaped portions, the U shaped portions are arranged, when the device is in the open configuration, such that the arms of the U face one another. The device may be further arranged such that, when in the closed configuration, the arms of the U shaped portions come together to form the pocket.

In some embodiments, the arms of the U shaped portion of the body element may be formed as part of the body element. In one embodiment, the one of the arms of the U shaped portion of the cover element forms a cover portion of the cover element arranged to overlie the body element when the device is in the closed configuration.

Alternative, or additional, embodiments may provide the cover element with an opening through which an activation pin may be inserted. Typically the opening is arranged such that when the activation pin is inserted the cover cannot be moved relative to the body element.

The device may be provided with a locking spring arranged to bias the activation pin. Conveniently the locking spring is arranged to resist insertion of the activation pin. The locking spring may also be arranged resist removal of the locking pin once inserted.

The body element may contain processing circuitry. The processing circuitry may be arranged to perform one or more of the following functions: monitor the presence of an operating bar to which the device is fitted; monitor the presence of an activation pin once the device has been activated; determine the position of device; determine whether the cover element is in a closed and/or open configuration; transmit data; transmit the position of the device; transmit alarms, perhaps if nefarious activity is detected.

Some embodiments of the monitoring device may also comprise an interconnector arranged to connect the monitoring device to a second operating bar. Such embodiments are believed advantageous in order to increase the secureness with which the monitoring device is held on the door and further increase the security provided by the device.

According to a second aspect of the invention there is provided a tracking device. The tracking device will typically comprise one or more of the following: a housing, one or more feet extendable relative to the housing. and alert means. Typically, the alert means is arranged to have a tracking mode in which at least one of the or each foot is compressed into the housing. The alert means may further be triggered to generate an alarm when the at least one foot is extended from the housing whilst the alert means is in the tracking mode.

The tracking mode may additionally or alternatively be thought of as a monitoring mode in which the status of the tracking device is monitored.

The tracking device may comprise a plurality of feet. In some embodiments these feet may operate independently of one another. However, in one embodiment, the feet are mounted upon a locator arranged to maintain the feet in a fixed position relative to one another.

Conveniently, the locator comprises a guide means arranged to co-operate with a complimentary means on a housing of the tracking device. In one embodiment, the guide means of the locator may comprise a plate, or the like, arranged to slide within a complementary groove on the housing. In other embodiments, the locator may comprise a groove, or other such opening, and the housing may comprise a plate, or other such male member, arranged to be received within the groove on the locator.

The tracking device may comprise an activation pin which, when inserted, holds the locator and/or feet in a fixed relation to the housing. The activation pin may be received within a complementary opening within each of the locator and housing.

The tracking device may comprise processing circuitry. The processing circuitry may comprise a detector arranged to detect the presence and/or absence of the locator.

The device may be arranged such that when the device is in the tracking mode the processing circuitry is arranged to generate an alarm if the detector does not detect the presence of the locator. This provides a convenient way of determining whether the feet have been extended from the tracking device. In other embodiments, the processing circuitry may be arranged to generate an alarm is the detector detects the presence of the locator.

Conveniently, the housing of the tracking device may comprise a guide arranged to receive a strop, strap, or the like, which provides convenient to secure the tracking device.

According to a third aspect of the invention there is provided a device for securing a cargo. The device may comprise a flexible light guide arranged to be placed to secure a cargo and have a signal of light transmitted therealong. The device may further comprise a processing circuitry arranged to generate, from time-to-time, the signal and transmit that signal along the light guide. The processing circuitry may further receive the signal after passage around the light guide. The processing circuitry may be arranged to trigger an alert mechanism should the signal not be received after being transmitted along the light guide.

As such, the device for securing cargo may be used to on doors or the like which might not be ISO freight containers. Conveniently, the light guide can be used to secure a door, etc. in a manner that necessitates cutting the light guide to open the door, remove the cable, etc. Should the light guide be cut then the processing circuitry does not receive the signal that it has transmitted and the alert mechanism can then be used to draw attention to the access to the cargo, freight, etc.

Conveniently, the processing circuitry comprises a light transmitter and/or light receiver. The light transmitter may be provided by an LED, which may be an Infra Red (IR) LED. The light receiver may be a photo diode or the like.

Conveniently, the light guide comprises a portion of fibre optic cable.

The alert mechanism may comprise a communication module arranged to transmit a signal.

The device may comprise an activation pin. Conveniently, the activation pin may be arranged to retain end regions of the light guide, typically within the device. Such a structure is convenient as it allows the light guide to be readily removed from the device when it is not being used.

The activation pin may comprise a channel therein arranged to receive end regions of the light guide. Conveniently collars are provided on end regions of the light guide, which collars are received within the channel in the activation pin.

Conveniently, the end portions of the light guide may be positioned adjacent the transmitter and/or receiver.

The following features may be utilised in relation to any of the first three aspects of the invention and the skilled person will appreciate how to modify the features accordingly.

The devices may be provided with an identifying mechanism which may be used to determine the identity of the device. Typically the identifying mechanism will provide a unique identity for the device to which it is attached.

For example, the identifying mechanism may be any of the following: a Quick Response Code (QR code); a bar code; an RFID tag; a serial number; or the like. Conveniently, the identifying mechanism is provided by a machine readable means ensuring that it can be read quickly.

The processing circuitry may comprise a communication module arranged to transmit and/or received data to/from the processing circuitry. The communication module may comprise a MODEM arranged to communicate over a wireless communication network. The wireless communication network may for example be a GSM, UMTS, 4G network or the like. The processing circuitry and/or communication module may be arranged to transmit the alarm generated by the monitoring circuitry. As such, the monitoring device may be arranged such that the no alarm is generated locally on the monitoring device and the transmission of the alarm by the communication module constitutes the sole alarm. Some embodiments may be arranged to generate an alarm locally, which may be an audible (eg a siren or the like) and/or a visual (eg a flashing light, LED, or the like).

In alternative, or additional, embodiments the communication module may be arranged to send SMS (Short Message Service) messages; MMS (Multimedia Messaging Service); or the like.

The processing circuitry may also comprise a position locator arranged to determine the location of the device in which it is provided. For example, the position locator may be provided by a Global Positioning System (GPS) receiver or other similar Global Navigation Satellite System (such as Galileo; Glonass; IRNSS). In other embodiments the position locator may be arranged to determine the position of the device by using the wireless communication network utilised by the communication module, use a gyroscope, or the like. In some embodiments, the processing circuitry may comprise more than one of the position locators described herein.

According to a fourth aspect of the invention there is provided a method of returning a device to a location, comprising at least one of the following steps a to f:

a) providing the device with an identifying mechanism;
b) using a reader to read the identifying mechanism associated with a monitoring device and generate one or more data packets containing the identity of the device;
c) transmit the datapacket(s) to one or more remote servers
d) causing the server to determine the location of the device for which the datapacket(s) have been received;
e) causing at least the location at which the identity of the monitoring device was read to be transmitted in one or more further datapacket(s), using a communication network, to a collection service;
f) causing the collection service to attend the location determined from the further datapacket(s), collect the monitoring device and return the monitoring device to a predetermined location.

Such a method conveniently allows a device to be returned to a desired location where it can be reused.

The device that may be returned by the method may include a monitoring device, a tracking device or any other device according to an aspect of the invention.

According to a fifth aspect of the invention there is provided a server arranged to:

a) receive one or more data packet(s) containing information identifying a device to be returned from a network connection to the server;
b) generate the location of the device to be returned; and
c) transmit the location of the device to be returned across the network connection to the server.

The location generated in part b) may be generated from information contained in the data packet(s) transmitted to the server across the network connection thereto. As such, the location may have been transmitted to the server from a reader used to read an identifying mechanism on a device to be returned.

According to a sixth aspect of the invention there is provided a machine readable medium containing instructions which when read onto a server cause that server to function as the server of the fifth aspect of the invention.

According to seventh aspect of the invention there is provided a machine readable medium containing instructions which when read onto a machine cause that machine to perform at least a part of the method of the fourth aspect of the invention.

The machine readable data carrier according to any of the above aspects of the invention may comprise a CD ROM/RAM; a DVD (−R/−RW; +R/+RW; RAM); a hard drive; any form of memory such as a flash drive, USB memory sticks, SD cards, or the like; any form of magneto optical storage; or the like.

The skilled person will appreciate that many of the features of above aspects of the invention may be interchangeable.

BRIEF DESCRIPTION OF THE DRAWINGS

There now follows by way of example only a detailed description of embodiments of the present invention with reference to the accompanying drawings in which.

DETAILED DESCRIPTION OF THE DRAWINGS

Figure 1:
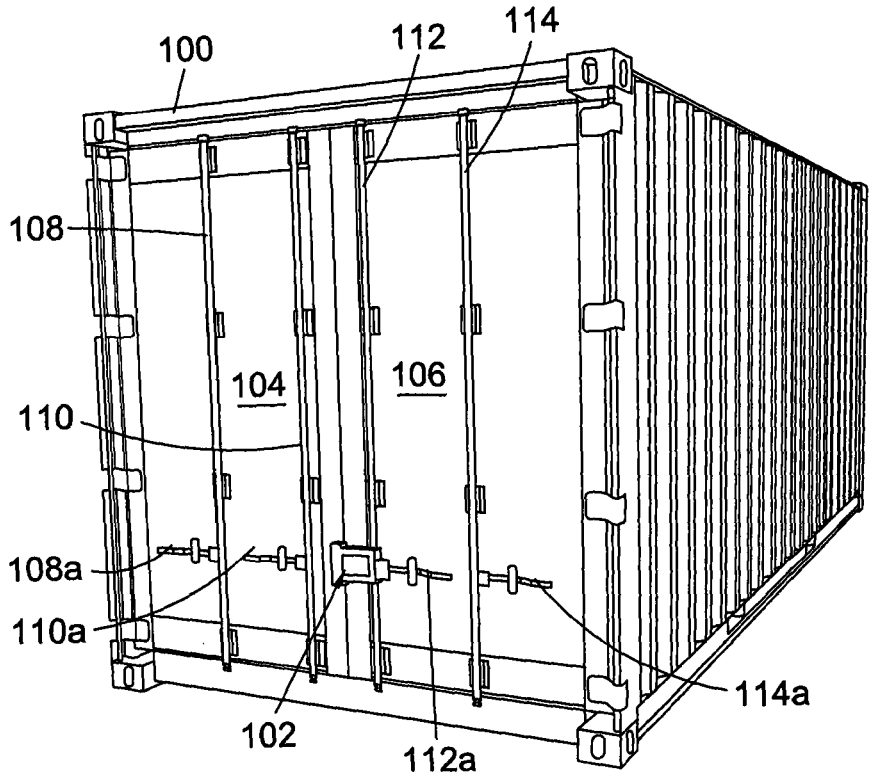
FIG. 1 shows an ISO freight container on which a monitoring device has been fitted.

FIG. 1 shows a typical, prior art, freight container 100 to which a monitoring device 102 according to an embodiment of the invention has been fitted. The freight container 100 is used to transport freight by typical transport means such as by road, rail, air or sea.

Such freight containers 100 are of standard dimensions and comprise left 104 and right 106 rear doors which enclose the volume provided by the freight container 100. Each of these doors 104, 106 is provided with a pair of operating bars 108, 110, 112, 114 which, in normal orientation, are vertical (ie upright) and each is arranged to rotate about its longitudinal axis to operate a cam at either end thereof. Operation of the cam causes engagement and disengagement with a respective mechanism on a frame of the freight container 100 thereby selectively securing the doors 104, 106 in a closed configuration.

Each operating bar 108-114 is provided with a respective handle 108*a*-114*a* which is pivotally connected to the operating bar 108-114 and allows a user to rotate the operating bar to open or secure the door 104, 106.

Each door 104, 106 is pivotally mounted upon the frame of the freight container 100 at it outer edges and are arranged to meet at a central region of the freight container 100. The edge region of the right door 106 which abuts the left door 104, at the central region of the rear of the freight container 100, is arranged to overlap the respective edge region of the left door 104, thereby ensuring that the left door 104 cannot be opened unless the right door 106 is first opened.

Figure 2:
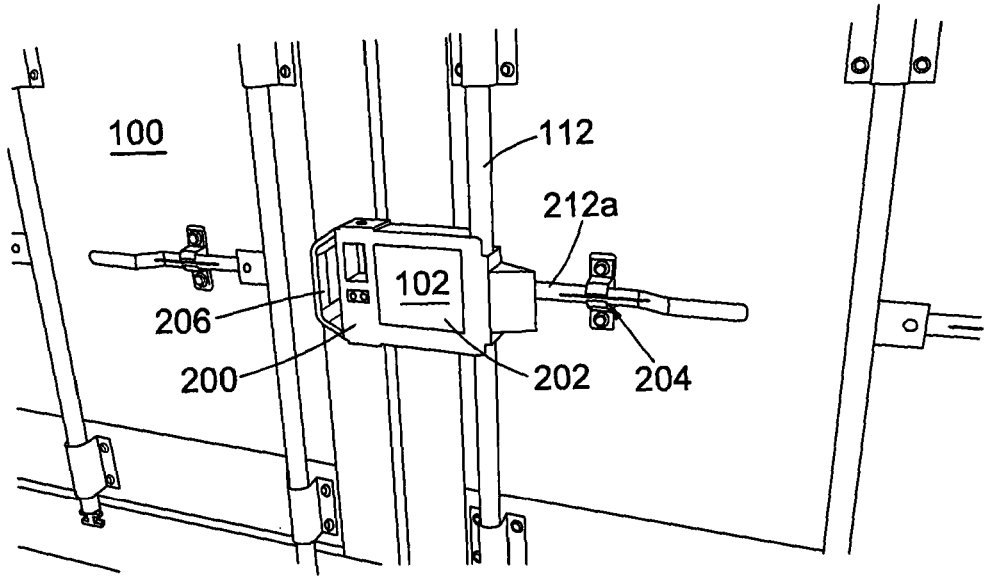
FIG. 2 shows more detail of the monitoring device of FIG. 1 fitted to a operating bar and handle of a door.

FIG. 2 shows an enlargement of the monitoring device 102 fitted upon the operating bar 112 of the right door 106; ie the operating bar 112 of the right door 106 nearest the left door 104. However, the device may also be fitted to any of the other locking bars 100-114.

It can be seen that a handle 206 is provided at a left end region of the monitoring device 102 (as viewed in the Figure with the monitoring device 102 mounted upon the container 100). The handle 206 not only facilitates carrying the monitoring device 102 when it is not attached to the container 100 but the handle 206 also extends over the left hand door 104. Having the handle 206 extend over then left hand door 104 in this manner further ensures that the left hand door 104 cannot be opened whilst the monitoring device 102 is fitted. The skilled person will appreciate that such an arrangement may help embodiments being so arranged prevent, or at least detect, 'pull-past' in which the left hand door 104 is forcibly pulled past the right hand door 106.

As is illustrated further with reference to FIGS. 3 to 6, the monitoring device 102 comprises a cover element 200 which extends over a portion of the handle 112*a* thereby preventing the handle from being rotated away from the door 106 which in turn prevents rotation of the operating bar 112. The monitoring device 102 also comprises a body element 202. FIG. 2 shows the monitoring device 102 in a closed configuration in which it is secured in place on the operating bar 112.

The skilled person will appreciate that the handle 112*a* comprises a through-hole 204 through which custom seals may be fitted.

Figure 3:
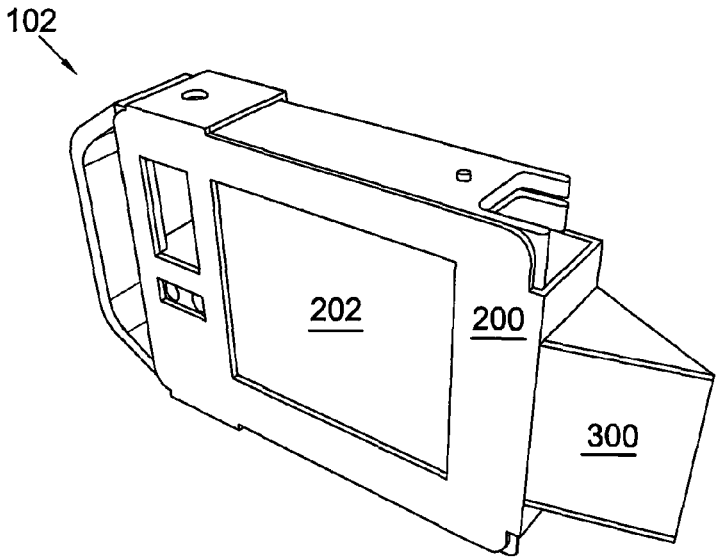
FIG. 3 shows an isometric view of the monitoring device of FIG. 2 in a closed configuration.

FIG. 3 also shows the monitoring device 102 in the closed configuration. To the right hand side of this Figure, there can be seen a handle-engagement portion 300 of the cover element 200; ie a portion of the cover element extends over a region of the handle 112*a* of the door. Referring again to FIG. 2, it will be seen that in the embodiment being described, the handle-engagement portion 300 is dimensioned so that the through hole 204 for the customs seals is still accessible. Dimensioning the handle-engagement portion 300 in this manner is advantageous since it means that the monitoring device 102 may be fitted to a operating bar 112/handle 112*a* which is already sealed with a seal.

Figure 4:
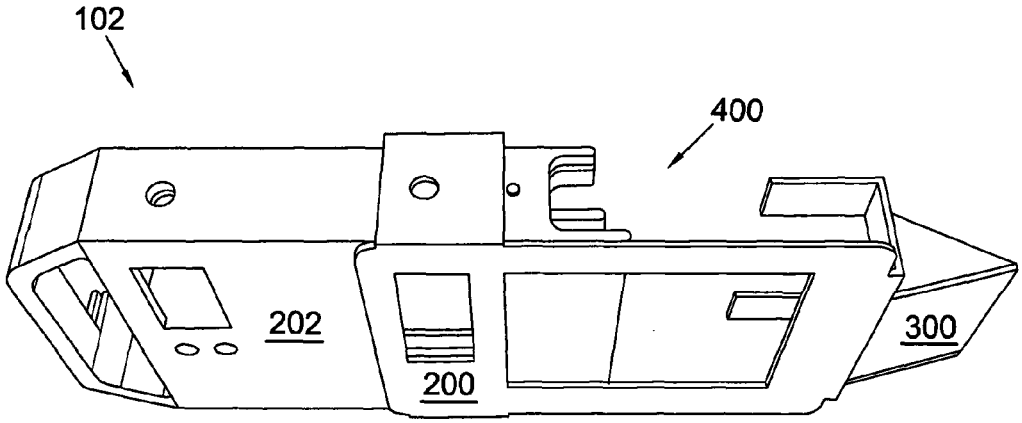
FIG. 4 shows an isometric view of the monitoring device shown in FIG. 2 in an open configuration.

To fit the monitoring device 102 to an operating bar 112/handle 112*a* the cover element 200 is slid relative to the body element 202 as shown in FIG. 4 which shows an open configuration of the monitoring device in which the cover element is extended relative to the body element. Moving the cover element to an open configuration creates an opening 400 through which the operating bar 112 can be passed. This opening can be more clearly seen in FIG. 5.

Figure 6:
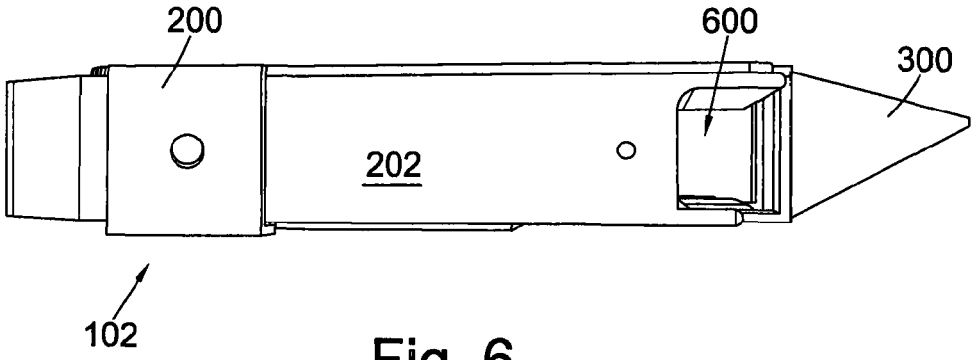
FIG. 6 shows a side view of the monitoring device of FIG. 2 in the closed configuration.

It will also be seen that each of the cover element 200 and the body element 202 comprise 'U' shaped portions 500 and 502 respectively. These U shaped portions are dimensioned to receive the operating bar 112 in between the arms of the U. Further, it will be seen that the U shaped portions are arranged such that the arms of the U face one another to fully enclose an operating bar 112 when the cover element 200 is moved to the closed configuration as shown in FIGS. 3 and 6.

Figure 5:
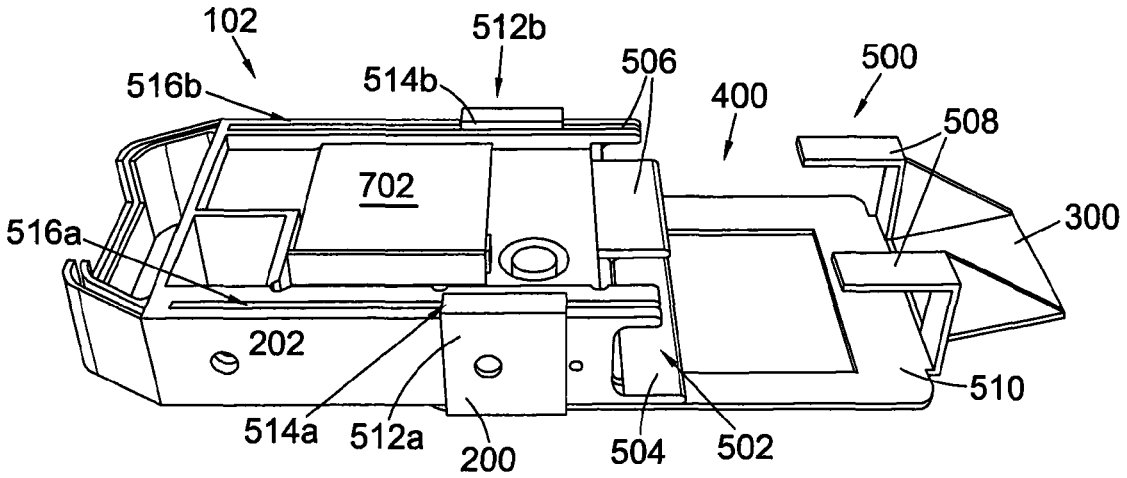
FIG. 5 shows an isometric view of the monitoring device of FIG. 2 in the open configuration.
Figure 10:
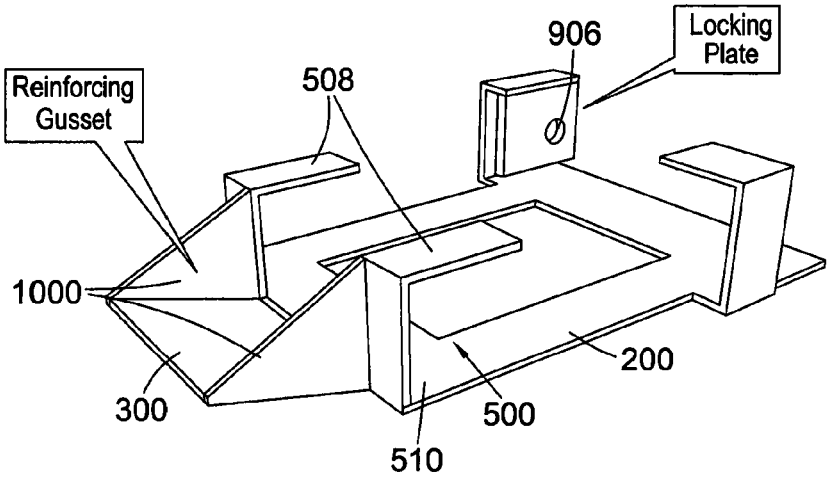
FIG. 10 shows further detail of a cover element of the monitoring device of FIG. 2.

In the open configuration shown in FIG. 5, it is possible to see both arms 504, 506 of the U shaped portion of the body element 202 and also to see both arms 508, 510 of the U shaped portion of the cover element 200. It will be seen that, in the embodiment being described, that one of the arms 510 of the U shaped portion 500 of the cover element 200 is provided by an outer surface of the cover element 200 (thereby forming a cover portion which overlies the body element when the monitoring device is in the closed configuration) and the other arm is provided by portions (in this case two) of the cover element 200 that have been folded back on themselves. Further details of the cover element 200 are seen in FIG. 10. Some embodiments may utilise the cover element 200 overlying the body element 202 to protect the body element 202 from attack.

At least some of the embodiments of the invention are arranged such that the cover element 200 is captive on the body element 202 such that it cannot readily be removed therefrom. Such embodiments are believed advantageous because it becomes difficult to forcibly remove a monitoring device 102, in which damage is likely to occur, and refit that same device after it has been repaired by combining parts from a plurality of other devices. Prior art devices which comprises a plurality of separable parts may be easier to repair by simply replacing damaged parts.

In the embodiment being described, the cover element 200 includes arms 512*a,b*, end regions 514*a, b*, of which are received in channels 512*a,b* within the body element 202.

Once the operating bar 112 is within the opening 400, the cover element 200 is slid back toward the body element 202 to take the position shown in FIGS. 3 and 6. However, the skilled person will appreciate the FIGS. 3 and 6 do not show the operating bar 112. FIG. 6 does however show a view of the enclosure 600 (ie a pocket) that is formed by the U shaped portions of the cover element 200 and the body element 202 coming together.

Figure 7:
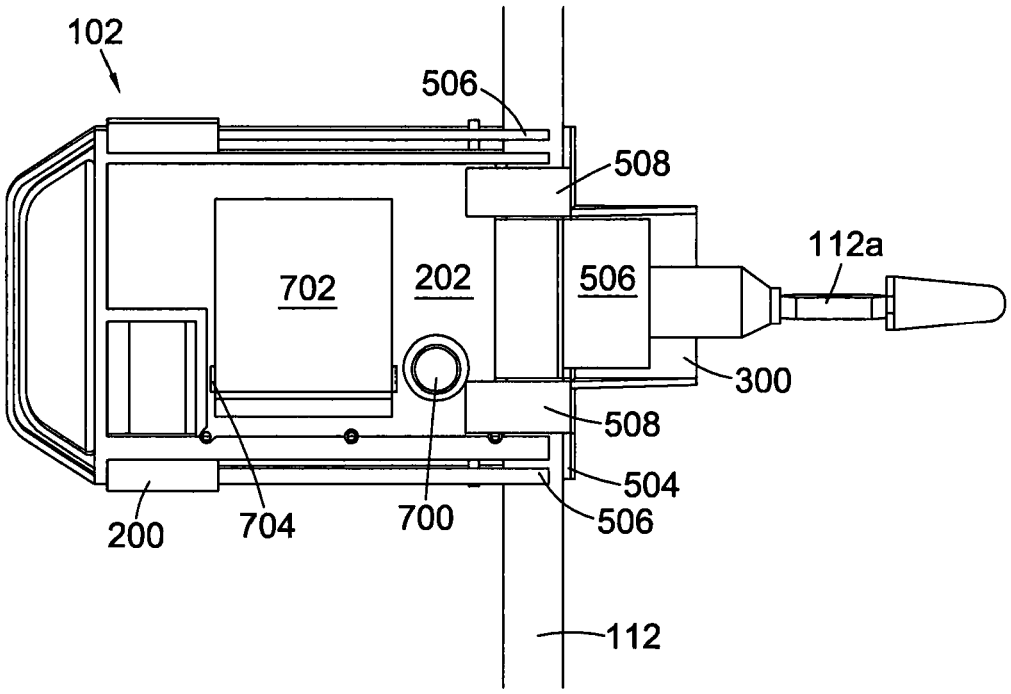
FIG. 7 shows a the monitoring device of FIG. 2 secured around an operating bar.

FIG. 7 shows a further detail of the monitoring device 102, but from an underside thereof, which, in use, is positioned against a door 104, 106 of the freight container 100. The handle 112*a* associated with operating bar 112 is seen to the right-hand side of the Figure with the handle-engagement portion 300 overlying the handle 112*a*. It is also possible to see the arms 508 and 510 of the U shaped portion 500 of the cover element 200 and the arms 504 and 506 of the U shaped portion 502 of the body element 202 which have come together to completely surround the operating bar 112.

An opening 700 is provided within the underside of the monitoring device 102, under which there is a communication port through which a physical connection can be made to a circuit board inside the cover element 202. In this embodiment, the physical connection is a USB connection which allows data interchange, reprogramming of the firmware and charging of processing circuitry provided on the circuit board. The opening 700 may be a ruggedized USB port. Additionally, or alternatively, to the USE port, a wireless connection (such as Bluetooth, or the like) may be provided.

Also visible, in FIG. 7, on the underside of the body element 200 is a pouch 702 which is covered by a lid hingedly, via a hinge 704, attached to the body element 200. In other embodiments, the lid may also slide into a receiving mechanism (such as a groove), snap onto, or otherwise engage with the body element 200. The pouch 702 is arranged to contain a courier envelope and/or other documentation to be used in the reverse logistics described below.

Figure 8:
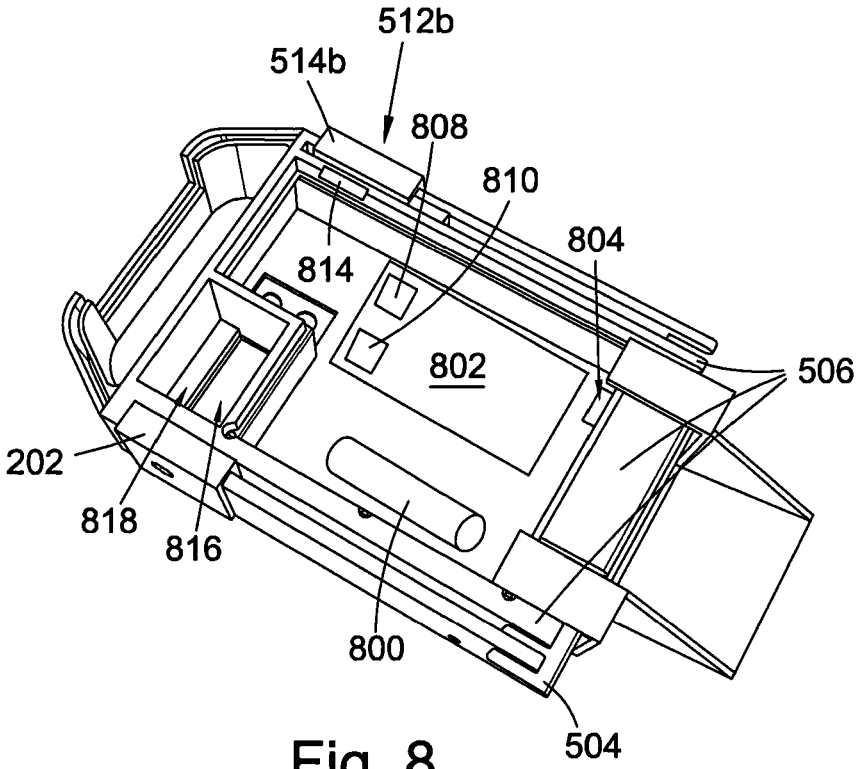
FIG. 8 shows internal details of a body element of the monitoring device of FIG. 2.

FIG. 8 shows the internal details of the monitoring device 102 which, in this embodiment, has a removable back surface. It will be appreciated that in use and when mounted upon a freight container 100, the back surface is not accessible.

Within the body element 202 there is a power supply 800, which in this embodiment is a battery, and the circuit board 802 containing processing circuitry. The processing circuitry includes an operating bar sensor 804, arranged to detect the presence of an operating bar 112 to which the monitoring device 102 is attached. Thus, the monitoring circuitry may comprise a sensor arranged to detect the presence of an activation bar on which the monitoring device 102 is mounted.

The operating bar sensor 804 may be any of the following: a magnetic sensor, such as a reed switch of the like; an optical sensor, such as a light sensitive resistor, etc., a physical switch such as a micro-switch; or any other suitable sensor.

The processing circuitry also includes a communication module 808 arranged to communicate with remote devices and generate alerts as described hereinafter. The communication module is typically a GSM MODEM or the like arranged to communicate with wireless telephone networks. The communication module may also be a 3G or 4G MODEM or the like.

In some embodiments, the processing circuitry may also include a position locator 810 such as a Global Positioning System (GPS), or other Global Navigation Satellite System (GNSS) receiver such that the processing circuitry 802 may determine its position. Alternatively, or additionally, it is conceivable that the position locator 810 may comprise sensors such as giro-scopes, or the like, or any of the other mechanisms described herein.

The monitoring device 102 also comprises a body sensor 814 positioned on the body element 202 and arranged to detect the presence of the end region 514*b* of the arm 512*b* of the cover element 200. Thus, the body sensor 814 may be thought of as being arranged to monitor the relative condition of the body 202 and cover 200 elements; the monitoring circuitry comprises a body sensor arranged to detect the presence of the cover element.

The body sensor 814 may be any suitable form of sensor such as an optical sensor (eg a light sensitive resistor, or the like); a magnetic sensor (such as reed switch or the like); a physical switch (such as a micro switch or the like). Embodiments utilising non-contact sensors are likely to be preferred due to the resilience and more robust nature.

The processing circuitry 802 may be arranged to monitor the location of the monitoring device 102 using the position locator 810. Further the processing device may be arranged to transmit, from time to time, the location of the monitoring device using the communication module 808. Additionally, or alternatively, the processing circuitry may be arranged to store within a memory thereof the position of the monitoring device 102. Such embodiments which monitor and record and/or transmit the location of the monitoring device 102 are believed advantageous in that they build up an audit trail for that monitoring device 102. The audit trail may be arranged to record any one ore more of the following: when the monitoring device 102 was stationary, when the monitoring device 102 was moving; the speed at which the monitoring device 102 was moving, or the like. The audit trail may comprise a time-stamp, which may be derived from a GNSS signal. Embodiments that transmit the location to a location remote from the device may additionally be advantageous in that they can provide the location of goods (eg those within a container being monitored) which may be used in determining the robustness of a supply chain, identifying when goods are likely to arrive, and the like.

Additionally, the processing circuitry 802 may be arranged to transmit, via the communication module 810, the status of the device. The status of the device may include any of the following: the condition of the body and cover elements; the presence of the activation bar; or the like.

Embodiments may be arranged to utilise the readings of the operating bar sensor 804; the body sensor 814, or the position locator 810, or any other sensors to provide the status of the monitoring device 102.

Some embodiments may be arranged to include the status of the monitoring device 102 in addition to the location of the device as part of the audit trail either kept on the device or transmitted remotely of the device via the communication module 808. Such embodiments are believed advantageous as they may be used in determining that nefarious activity has occurred even if the monitoring device 102 appears to be physically intact when it arrives at its destination.

Figure 9A:
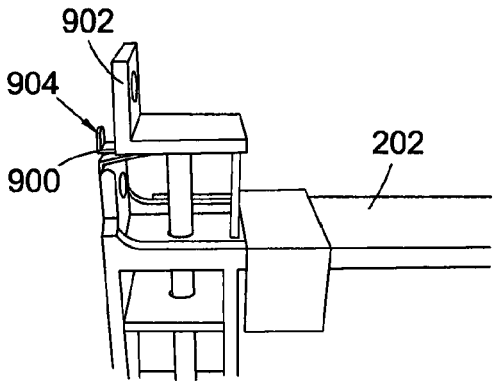
FIG. 9*a* shows the function of a locking spring provided on the monitoring device of some embodiments in which an activation pin provided in an inactive position.

FIGS. 9*a* and *b* show details of an embodiment that utilises a locking spring 900, which is attached to a side of the body element 202 opposite to the U shaped portion 502, and wherein the locking spring 900 is arranged to engage with an activation pin 902. Other embodiments need not be so arranged to use the locking spring.

FIG. 9*a* shows the activation pin 902 in an inactive position in which it has not been fully inserted into the body element 202 through a complementary opening in the body. It can be seen that a tab 904 at an end region of the locking spring 900 interacts with the activation pin 902 thereby preventing it from being inserted into the body element 202 too readily.

Figure 9B:
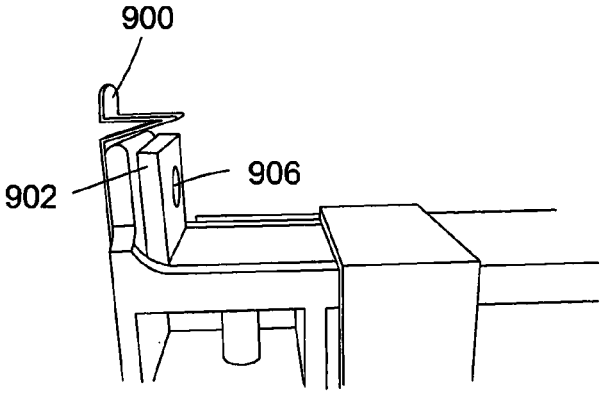
FIG. 9*b* shows the locking spring of FIG. 9*a* and the activation spring in an active position.

FIG. 9*b* shows the activation pin 902 in an active position in which it has been fully inserted into the body element 202. When the activation pin 902 has been fully inserted in this manner, then an activation pin sensor detects the presence of the activation pin 902 and arms the processing circuitry on the circuit board 802. It will also be seen that the tab 904 extends over the end of the activation pin thereby urging the activation pin 902 into the active position once it has been inserted.

An end region of the activation pin 902 is provided with a through-hole 906 which is arranged to co-operated with a corresponding through-hole 906 in region of the cover element 200 when the activation pin 902 is in the active position. The through-hole 906 is the cover element 200 is best seen in FIG. 10. When the monitoring device 102 has been fitted as described above, and the activation pin 902 inserted to the active position then a padlock, ISO standard customs seal be used to secure the activation pin 902 in the active position. The skilled person will appreciate that with the activation pin 902 so secured in position that it is not possible to slide the cover element 202 relative to the body element 200 unless significant force is used. Thus, the activation pin 902 not only activates the processing circuitry but it also physically secures the cover element relative to the body element.

In other embodiments, such as that shown in FIGS. 2 to 8 and activation pin 902 need not be provided and those embodiments may be arranged to be armed when the body sensor 814 detects the cover element 202. In addition, it will be seen that monitoring device 102 comprises a void 816, adjacent a hole 818 through the body element 200.

Turning to FIG. 10, then the cover element 200 can be seen in more detail. In both of the embodiments being described, the cover element 200 is fabricated from mild steel, which may be galvanised in order to increase is weather resistance. However, gusset portions 1000 of the handle engagement portion 300 and/or the portion around the through hole 906 for the activation pin are, in the embodiment being described, fabricated from thicker gauge steel that other portions.

In the embodiment being described, the body element 202 is fabricated from a plastics material which is advantageous since is light weight than other materials, such as steel and the like, whilst being corrosion resistant. Further, the cover element 200 is arranged to provide sufficient strength to prevent nefarious access to the handle 112*a* and the internals of the body element 202.

In the embodiment of FIGS. 2 to 8, the through hole 906 is arranged, when the cover member 202 is in the closed configuration, to align with the hole 818 in the body element 200. As such, a standard customs security seal (or other means such as a padlock, ZIP tie, or the like) may be arranged to secure the monitoring device 102 in the closed configuration by physically locking the cover 202 and body 200 elements together.

Some embodiments may be provided with an interconnector arranged to attach the monitoring device to the operating bar on the left-hand door of the freight container. Such an interconnector helps to hold the monitoring device 102 securely in place and prevent the left 104 and right 106 doors of the freight container 100 from being opened.

Once the monitoring device, either with or without the interconnector 1100, is fitted to the operating bars 110, 112 a user thereof inserts the activation pin 902 which is detected by the processing circuitry inside the body element 202, or closes the cover member 202 which is in some embodiments is detected by the processing circuitry via the body sensor 804. Once the processing circuitry has been activated then the communication module is arranged to transmit, from time to time, a signal. This signal is monitored by a remote service and can be used to track the location of the monitoring device 102 and consequently the freight container 100 to which it is attached. As discussed above, this signal allows an audit trail of the monitoring device 102 to be recorded.

The operating bar sensor 804 monitors for the presence of the operating bar 112. Whilst the cover element 200 should ensure that the monitoring device cannot be removed from the operating bar 112 should nefarious, or other activity, result in the monitoring device 102 being removed from the operating bar 112 whilst it is still active then the communication module is arranged to generate a signal indicating that the freight container 100 has been opened. In order to prevent such an alert from being generated the activation pin 902 must first be removed from the body element 202.

According to another aspect of the invention there is provided a tracking device than can, like the embodiment described in relation to FIGS. 1 through 10, be used to track items of cargo. However, the device now described in relation to FIGS. 11 to 16 does not secure the rear doors of a freight container in the manner of the previously described embodiment.

Figure 11:
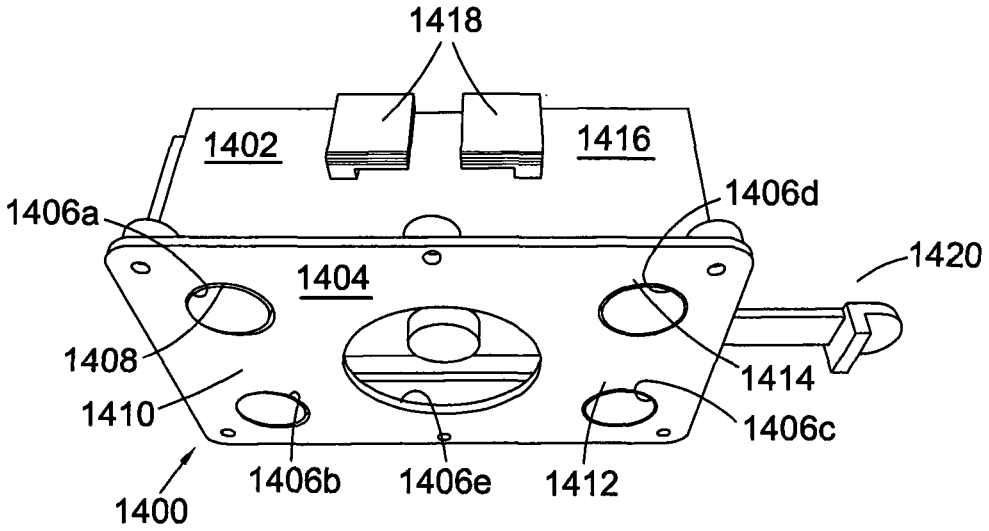
FIG. 11 shows a tracking device according to another aspect of the invention in a first configuration.

As can be seen in FIG. 11, the tracking device 1400 (the tracking device may be thought of as a monitoring device) comprises a housing 1402 having a base plate 1402 wherein the base plate 1404 is, in use, arranged to be located adjacent a piece of cargo to be tracked. As described below, the housing 1402 contains various components that provide the tracking functionality of the tracking device 1400.

The base plate 1404 comprises five opening therethrough 1400*a-e*. The first four of these opening 1406*a-d* allow retractable feet 1408-1414, whose functionality is described below, to protrude through the base plate 1404; ie the feet are extendable relative to the housing. The fifth opening 1406*e* allows access to a communication port. In this embodiment, the communication port is a USB interface, but in other embodiments the port may any other suitable protocol (such as Firewire or the like).

On a side region 1416 of the housing there are provide guides 1418 arranged to guide locating means to hold the tracking device in place. For example, the locating means may comprise a strop, strap, band, or the like.

An activation pin 1420 can also be seen to the right hand side of the Figure, which as described below, is used to cause the tracking device 1400 to enter a tracking mode.

Figure 13:
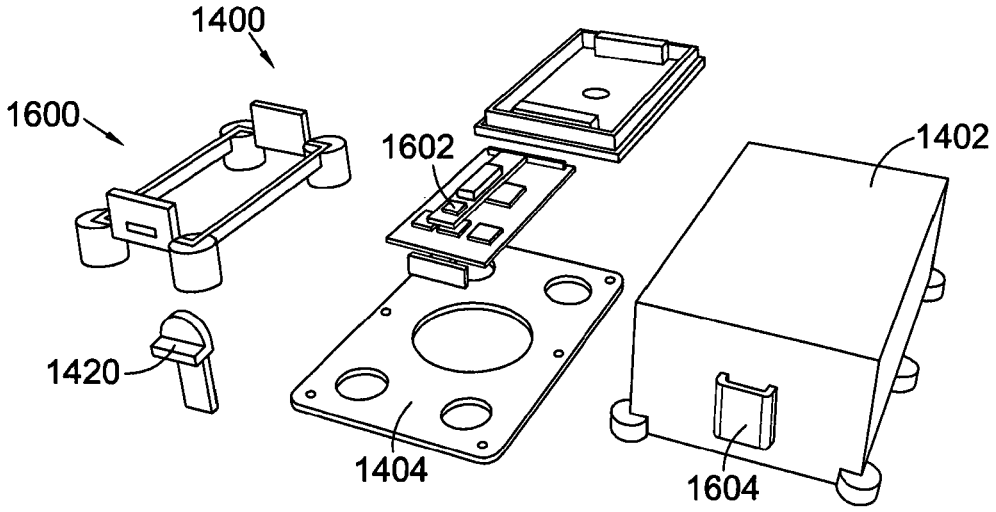
FIG. 13 shows some of the components which constitute the tracking device of FIG. 14.

FIG. 13 shows the activation pin 1420 removed from the tracking device 1400 and consequently, the feet 1408-1414 have been retracted inside the housing 1402 such that the bases of the feet 1408-1414 are substantially flush with the bottom of the base plate 1404. In other embodiments, the feet may protrude slightly from the base plate even when the tracking device is in the tracking mode. However, it is believed advantageous to have the base of the feet 1408-1414 to be flush with the bottom of the base plate 1404 in order to provide a large surface area to increase contact with an item being tracked. In some embodiments, for example if attached to an irregular surface, there may be some in-built adjustability or tolerance that activates the unit before the feet are fully retracted.

Figure 12:
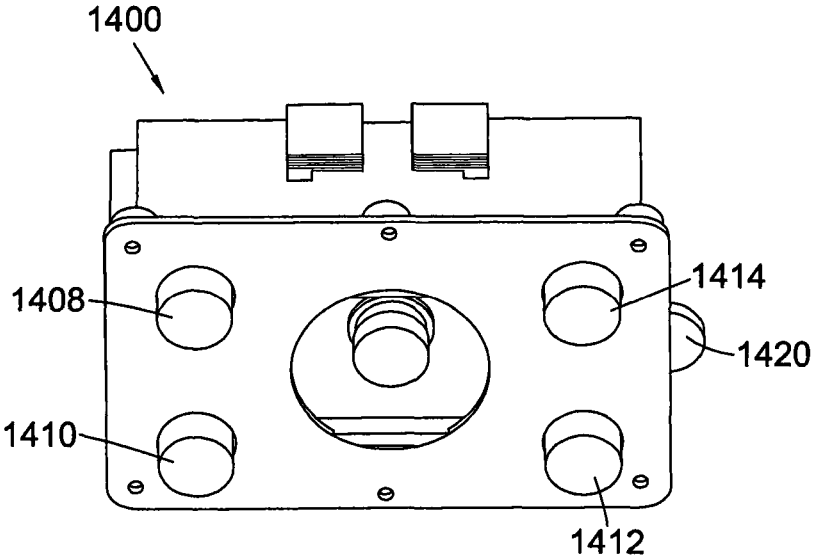
FIG. 12 shows the tracking device of FIG. 11 in a second configuration.

FIG. 12 shows the tracking device 1400 in an inactive mode in which the activation pin 1420 is fully inserted. In this inactive mode, it will be seen that the four feet 1408-1414 extend beyond the bottom surface of the base plate 1404.

FIG. 13 shows the main components of the tracking device 1400 which include the housing 1402, the base plate 1404 and activation pin 1420 already described. In addition to these components there is a sensor element 1600 which is shown in more detail in FIG. 14. Further, the tracking device 1400 comprises a circuit board 1602 containing processing circuitry.

A storage port 1604 is provided for the activation pin 1420 on an outer surface of the hosing 1402.

Figure 14:
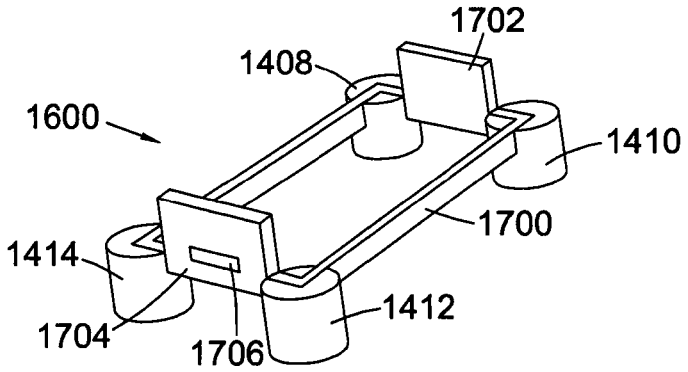
FIG. 14 shows an enlargement of a sensor element of the tracking device.

Further detail of the sensor element 1600 can be seen in FIG. 14 and it can be seen that in this embodiment the sensor element 1600 comprises a locator which is provided by a rectangular frame 1700. The locator is thus arranged to maintain the feet in a fixed position relative to one another. At corner regions of the rectangular frame 1700 there is provided one of the feet 1408-1414. In other embodiments means other than a rectangular frame may be provided as the locator which locates the feet 1408-1414 relative to one another. Indeed, it is conceivable that the feet 1408-1414 need not be interconnected with one another and an activation pin may be provided for a single foot or a sub-set of the total number of feet.

Figure 15:
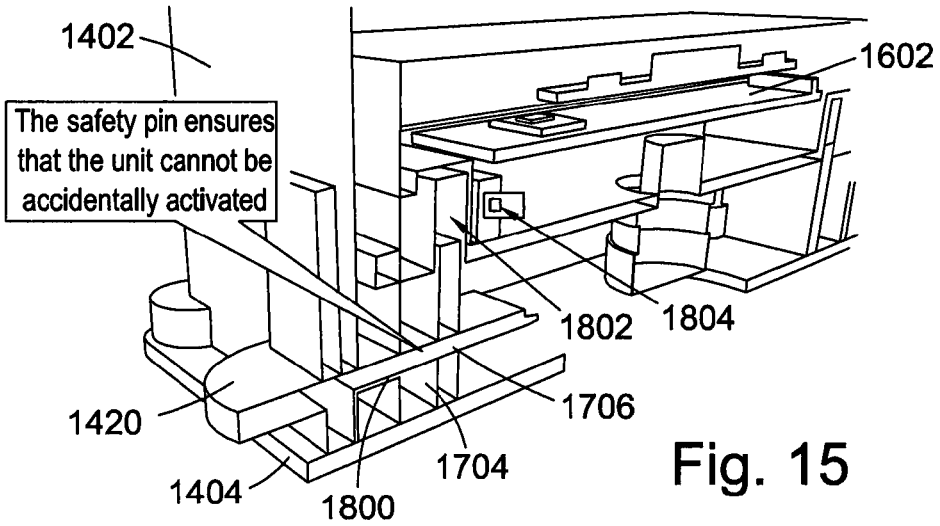
FIG. 15 shows a section through the tracking device of FIG. 11.

At each of the narrow end regions of the rectangular frame 1700 there is provided a guide means 1702, 1704 which are arranged to move within co-operating means (in this case channels) on the housing 1402 which channels can be seen in more detail in FIG. 15. In this embodiment the guide means 1702, 1704 comprise substantially planar plates. In other embodiments, the housing 1402 may be provided with male elements arranged to slide within co-operating channels of the locator 1700.

At least one of the guide means, and in this embodiment, only one of the guide means 1704 comprises a hole therethrough 1706 which is large enough to receive the activation pin 1420 therethrough.

Turning to FIG. 15, it can be seen that the housing 1402 also has a hole 1800 therethrough large enough to receive the activation pin 1420. The guide channel 1802 arranged to receive the guide means 1702, 1704 of the locator 1700 is also visible.

The housing 1402, the guide channel 1802 and holes 1706, 1800 (which may be thought of as openings) are arranged such that when the feet 1408-1414 are protruding from the base plate 1404, in the inactive mode, the hole 1706 in the locator 1700 is aligned with the hole 1800 in the housing. Thereby, the activation pin 1420 can be inserted through both holes 1706, 1800 thereby preventing relative movement of the locator 1700 and the housing 1402.

In order to activate the tracking device 1400 and cause it to enter the tracking mode, a user removes the activation pin 1420 thereby releasing the locator 1700 to move relative to the housing 1402. A user may store the activation pin 1420 in the storage port 1604. Once the activation pin 1420 has been removed the guide means 1702, 1704 are free to move along the guide channel 1802 and thereby the locator 1700 is free to move relative to the housing 1402 and the feet 1408-1414 are free to retract.

Also visible in FIG. 15 is a guide means sensor 1804 arranged in a top region of a guide channel 1802 such that when the guide means 1702, 1704 moves within the guide channel 1802 the presence of the guide means 1702, 1704 is detected. The processing circuitry on the circuit board 1602 can then monitor whether the feet 1408-1414 of the tracking device have been caused to extend. Thus, the sensor is arranged to detect the presence and/or absence of the locator.

Figure 16:
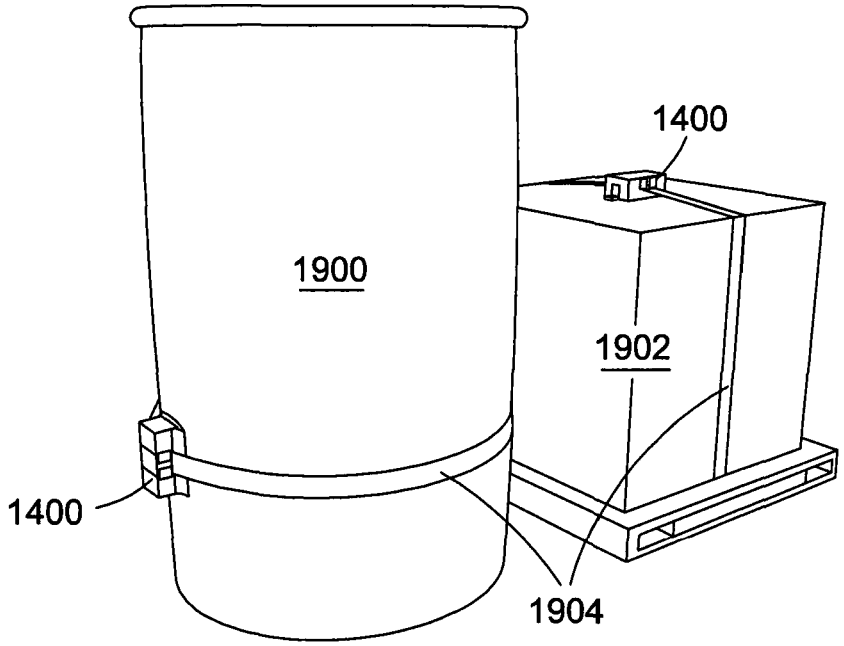
FIG. 16 shows the tracking device of FIG. 11 mounted upon items of cargo.

FIG. 16 shows the tracking device 1400 described above mounted on pieces of cargo 1900, 1902 that a user wishes to track. In use, a user places the tracking device 1400 against the piece of cargo 1900, 1902, removes the activation pin 1420 thereby allowing the feet 1408-1414 to retract into the housing 1402.

Once the feet have retracted the user may fasten the tracking device 1400 to the cargo 1900, 1902 and in this case it can be seen that a strap has been used. The skilled person will appreciate that the tracking device 1400 will still function if a strap is not used and the tracking device were simply left to rest on an item. However, it may be more convenient if the tracking device is secured to the item of cargo 1900,1902.

As the feet 1408-1414 retract into the housing 1402, the guide means 1702, 1704 slide along respective guide channels 1802 and the guide means sensor 1804 detects the presence of the guide means 1702, 1704. Once the guide means 1702, 1704 has been so detected the tracking device 1400 enters the tracking mode in which, from time-to-time the processing circuitry transmits via a communication module the position of the tracking device which has been derived from a position locator.

Typically, the position locator may be provided by a GPS receiver, but the skilled person will appreciate that position location may be derived from other mechanisms such as from triangulation of GSM (or other mobile telecomms) base stations and the like. Use of multiple types of position locator is advantageous since cargo and the like being tracked may be out of site of GPS satellites for prolonged periods and accordingly use of other techniques may be useful in providing position information more frequently. The skilled person will appreciate that it may be possible to utilise gyroscopes and the like to track position.

If the tracking device 1400 is removed from the cargo then the feet 1408-1414 will extend again thereby removing the guide means 1702, 1704 from the guide means sensor 1804 which is detected by the processing circuitry. Much in the same way that the monitoring device 100 generates an alarm if it is removed from the operating bar 112, the tracking device 1400 generates an alarm (which may be thought of as an alert) if the feet 1408-1414 as caused to extend. This alarm is transmitted in association with the position at which it occurred and alerts the user to the location at which the tracking device 1400 was removed from the cargo 1900, 1902. Thus, the processing circuitry comprises an alert means which is arranged to generate a transmission.

As with the monitoring device described in relation to FIGS. 1 through 10, this embodiment may be arranged to store locally an audit trail, and/or transmit sufficient information via the communication module to allow an audit trail to be recorded remotely.

Figure 17:
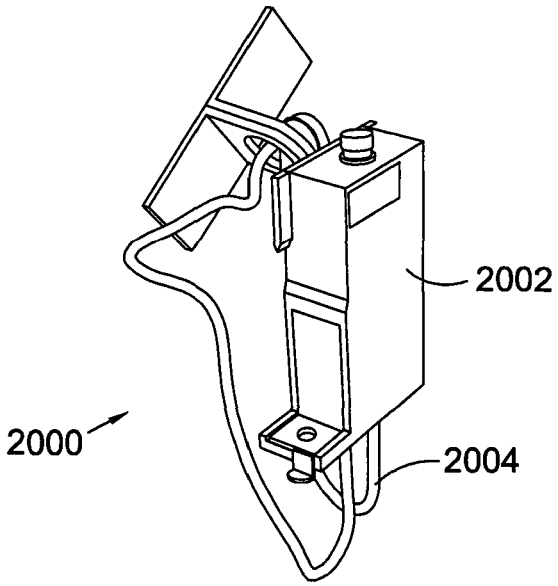
FIG. 17 shows a device for securing cargo.

FIG. 17 shows a further aspect of the invention which comprises a device 2000 for securing items of cargo. The device 2000 comprises a housing 2002, containing processing circuitry as described below together with a loop of cable 2004 which is connected at each end region thereof to the housing 2002 such the cable 2002 is in communication with the processing circuitry as described below. In this embodiment, the cable 2004 is a length of fibre optic cable which is believed advantageous since it is a lower power solution (when compared to using a length of electric cable) and is thought to be more resistant to corrosion from weather and the like. Thus, the cable 2004 may be thought of as being a flexible light guide.

Figure 18:
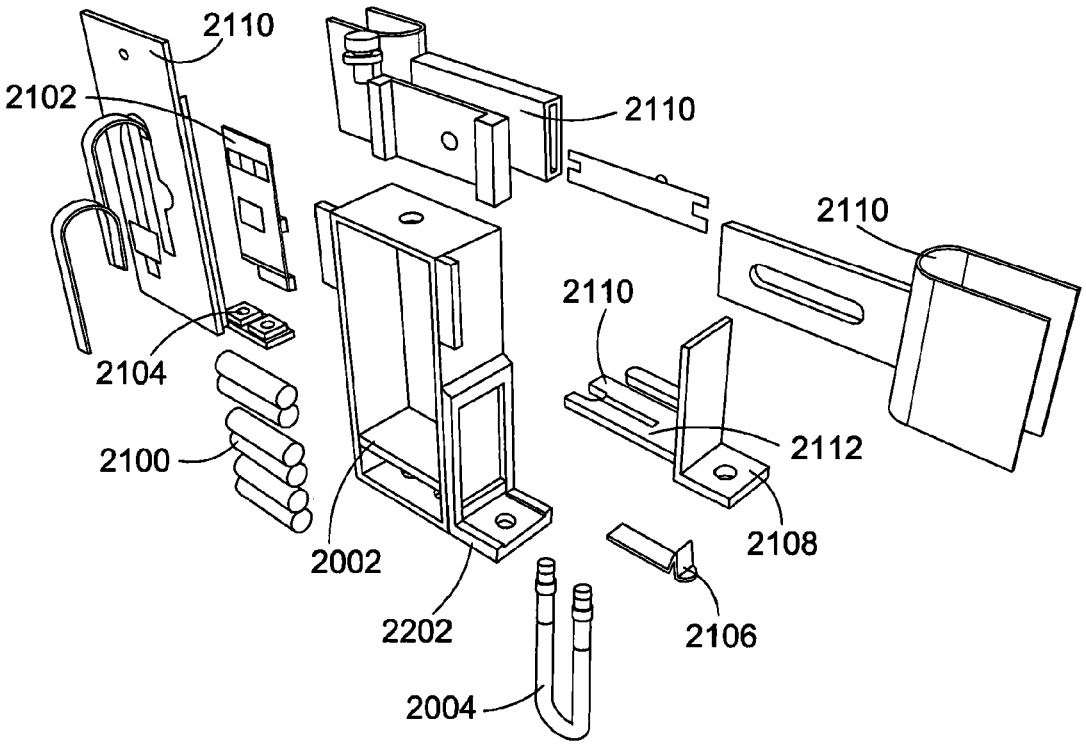
FIG. 18 shows the component parts of the device of FIG. 17.

The major components of the device 2000 are shown in FIG. 18. In addition to the components described in relation to FIG. 17, there is shown a power supply 2100, which in this embodiment comprises a set of batteries. However, other embodiments may include power supplies such as fuel cells, solar cells, super capacitors, etc in addition or instead of the batteries.

A circuit board 2102 is provided which contains processing circuitry which functions as described below. A daughter board 2104 is also provided and which connects to the circuit board 2102 wherein the daughter board 2104 each arranged to communicate with the cable when the cable is connected to the housing 2002. Each of the circuit board 2102 and the daughter board 2104 are powered by the power supply 2100.

Also seen in FIG. 18 is a locking spring 2106 which is arranged to interact with an activation pin 2108 as described below. A number of mounting components 2110 are also shown which allow the device 2000 to be mounted in a variety of manners.

Figure 19:
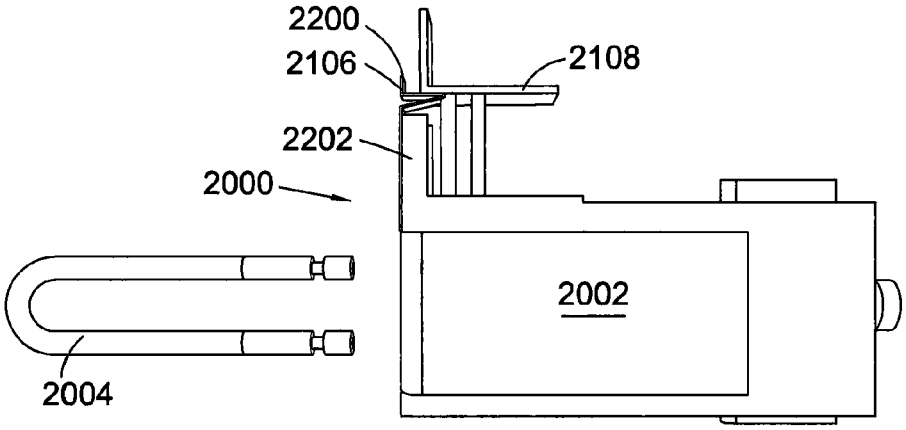
FIG. 19 shows the device of FIG. 17 in an open configuration.

The function of the activation pin 2108 and locking spring 2106 are described in relation to FIG. 19 and the skilled person will note that the function is, mutatis mutandis, similar to that described in relation to FIGS. 9*a* and 9*b* in relation to the first aspect of the invention.

In particular, the locking spring 2106 is mounted upon a bottom surface of the housing 2002 such that a tab 2200 extends beyond a flange 2202 of the housing 2002. Thus, the tab 2200 is arranged to impede motion of the activation pin 2108 into and out of the housing 2002 which comprises opening arranged to receive the activation pin 2108.

In order to insert the activation pin 2108, a user must retract the locking spring 2106 so that it no longer impedes the activation pin 2108, insert the activation pin 2108, and then release the locking spring 2106. When the locking spring 2106 is released with the activation pin 2108 inserted into the housing 2002, the tab 2200 extends over and end region of the activation pin 2108 thereby helping to maintain the activation pin 2108 in situ.

Figure 20:
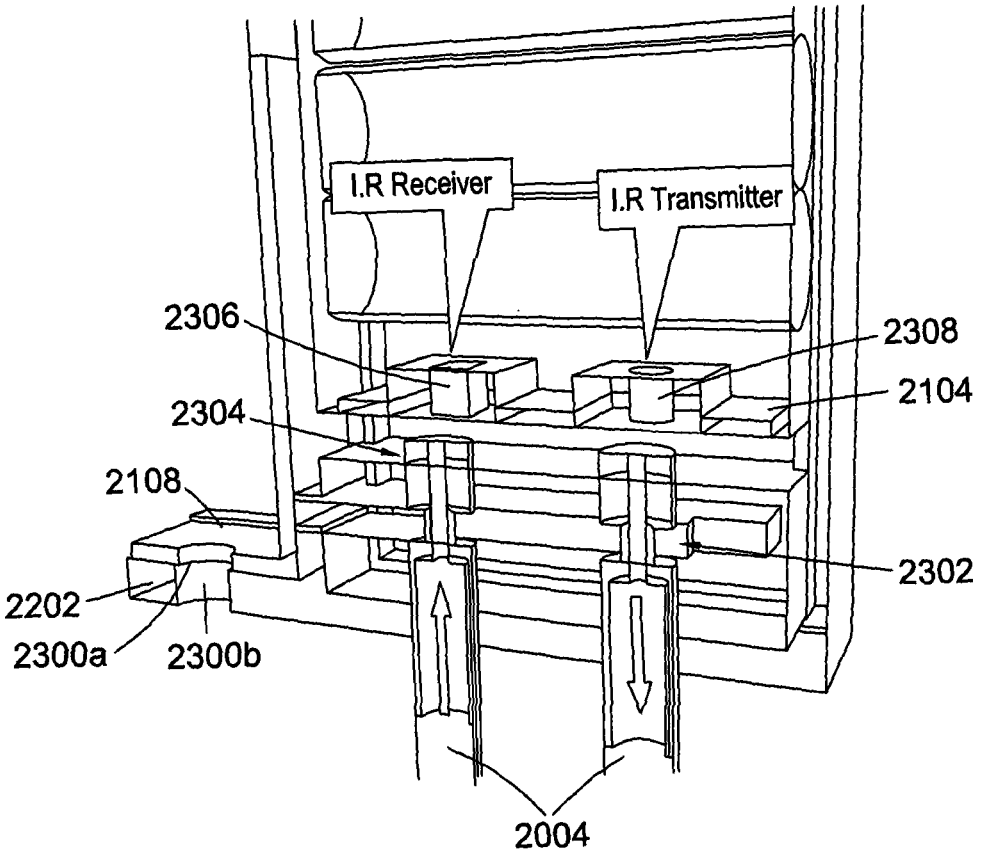
FIG. 20 shows a section through the device of FIG. 17.

As can be most readily seen in FIG. 20, each of the flange 2202 and the activation pin 2108 contain holes 2300*a, b* which become aligned when the activation pin 2108 is fully inserted into the housing 2002 thereby allowing the activation pin 2108 to be locked in place. For example a padlock, ISO Security Seal, Bolt Seal or Cable seal, or the like.

Figure 21:
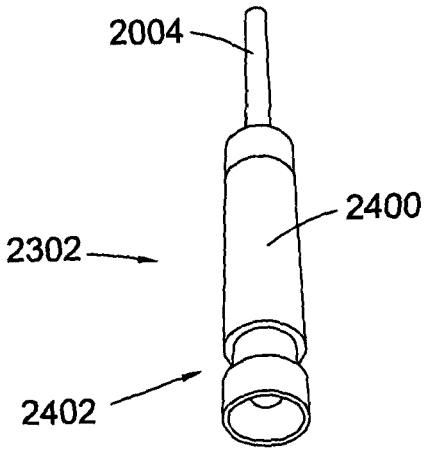
FIG. 21 shows an end region of a cable.

As can be seen in relation to FIGS. 20 and 21, each end region 2302, 2304 of the cable 2004 is provided with a cap 2400 having a groove 2402 therein. As can be seen in relation to FIG. 18, the activation pin 2108 comprises a plate 2110 having a U shaped channel 2112 therein. The U shaped channel 2112 is dimensioned such that the groove 2402 within the cap 2400 can be received therein and thereby the end cap 2400 can be received within the plate 2110.

Thus, in use, a user pushes the caps 2400 of the cable 2004 into the respective openings in the housing 2002. Whilst the caps 2400 are held in place, the user manipulates the locking spring 2106 and inserts the activation pin 2108. As the activation pin 2108 is inserted the U shaped channel 2112 receives the grooves 2402 within the caps 2400 thereby retaining the end regions of the cable 2004 within the housing 2002. A user can then lock the activation pin 2108 in place utilising the holes 2300*a*, 2300*b*.

A sensor detects the presence of the activation pin 2108 and causes a light transmitter 2306 which is positioned adjacent the end region of one of the caps 2400 on one end region of the cable 2004 to begin transmitting light. A light receiver 2308 is positioned adjacent the cap 2004 on the other end region of the cable 2308. Thus, light transmitted by the transmitter 2306 is caused to travel around the cable 2004 and be received by the receiver 2308.

Conveniently, the light transmitter 2306 is an LED.

In the embodiment being described, the light transmitted by the light transmitter 2306 is Infra Red (IR) light but other embodiments may use other frequencies. For example, any colour of light might be used.

The transmission of light by the light transmitter 2306 is controlled by the processing circuitry on the circuit board 2102 which causes the light transmitter 2306 to emit a pulse of light from time-to-time. This pulse of light may be thought of as being a signal which is transmitted around the cable 2004. From time-to-time may be taken to mean periodically or alternatively, a pulse may be emitted at irregular intervals, which may be randomly or according other algorithms. In one embodiment, a pulse of light is caused to be emitted roughly every 30 seconds, which helps to ensure that the power drain on the power supply 2100 is sufficiently low to ensure that the power supply 2100 is not drained too quickly. In this regard, the skilled person will appreciate that the more light that is transmitted along the cable 2004 then the higher the power drain.

In other embodiments pulses of light may transmitted at other intervals and may be at any of the following intervals: 5 seconds; 10 seconds; 15 seconds; 20 seconds; 45 seconds; 60 seconds; 100 seconds; 120 seconds; 5 minutes or more.

Once a pulse has been transmitted along the cable 2004 by the light transmitter 2306 the processing circuitry 2102 is arranged to monitor the light receiver 2308 to ensure that that light pulse is received. Should the pulse not be received by the light receiver 2308 then the processing circuitry is arranged to generate an alarm since a lack of receipt of the pulse by the light receiver 2308 would typically indicate that the cable 2004 has been cut.

Accordingly, in use, the cable 2004 may be wound around, passed through, etc. cargo or other object that it is desired to protect in such a manner that the object cannot be removed without the cable 2004 being broken. Once the device is activated, then failure of the cable 2004 and the failures subsequent detection by the device 200 is likely to mean that nefarious activity has taken place. Typically the cable will be passed through and eyelet, perhaps in-front of a hasp which is passed over the eyelet. The skilled person will appreciate that if the cargo, freight or the like can be removed without cutting the cable 2004 the utility of the device 2000 is reduced or removed.

Deactivation of the device is the reverse of the activation procedure described above.

The alarm generated by the device 2000 may cause a signal to be transmitted by a communication module of the processing circuitry. As with the other aspects described above, the communication module may typically be a GSM modem or the like but could also be any other suitable module as described elsewhere. Thus, the processing circuitry that is used to generate that alarm and/or transmit the alarm may be thought of as being an alert mechanism.

The communication module may also be arranged to transmit the location of the device 2000 using any of the position locators described herein (eg GPS, triangulation, etc).

Each of the three aspects described above comprise a processing circuitry and the devices may be arranged such that the processing circuitry is common, mutatis mutandis, between the three aspects. As such, each of the three aspects may be utilised to monitor, track and/or secure items of cargo, or other objects. The skilled person will appreciate that features described in relation to any one of the above embodiments or aspects of the invention may be applied to other aspects or embodiments of the invention to address the problems described herein, at least some of which, are common to each of the aspects and/or embodiments.

It will be appreciated that the devices 102, 1400 and 2000 may each be used to track items of cargo and the like. Further, it will be appreciated that cargo moves from point A to point B via a number of intermediary points, where point B is its intended destination.

Should the devices 102, 1400, 2000 be used to track that cargo then the device 102, 1400, 2000 will also end up at point B, or perhaps at one of the intermediary points if the device 102, 1400, 2000 is only used to track the cargo for a portion of its journey. Thus, there is a desire to recover the monitoring and/or tracking device 102, 1400, 2000 in order that it may be re-used. Recovery of the monitoring and/or tracking device in this manner may be referred to as reverse logistics.

Figure 22:
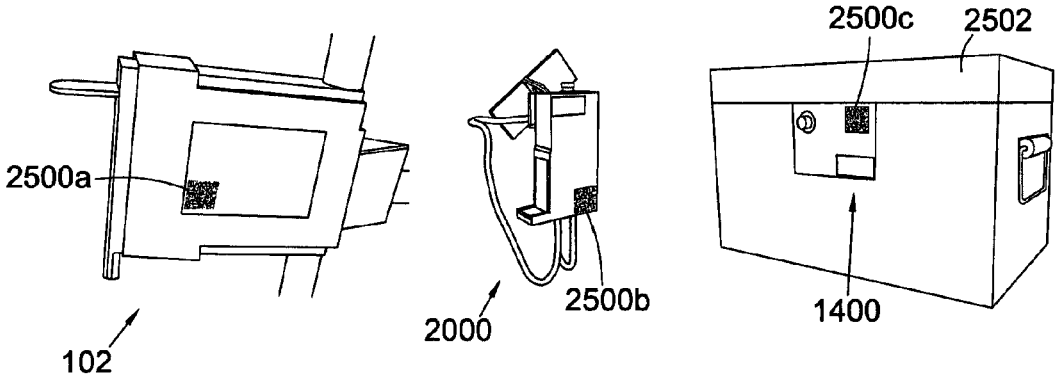
FIG. 22 shows devices on which a identifying mechanism has been provided.

In one aspect of the invention, the devices 102, 1400, 2000 are marked with an identifying mechanism 2500*a,b,c* and an example is shown in FIG. 22. It will be noted that the tracking device 1400 is shown inside a container 2502, rather than on the outside and the tracking device 1400 is suitable for such, what may be thought of as covert, tracking.

Figure 23:
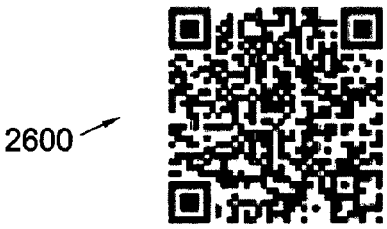
FIG. 23 shows an example of an identifying mechanism.
Figure 24:
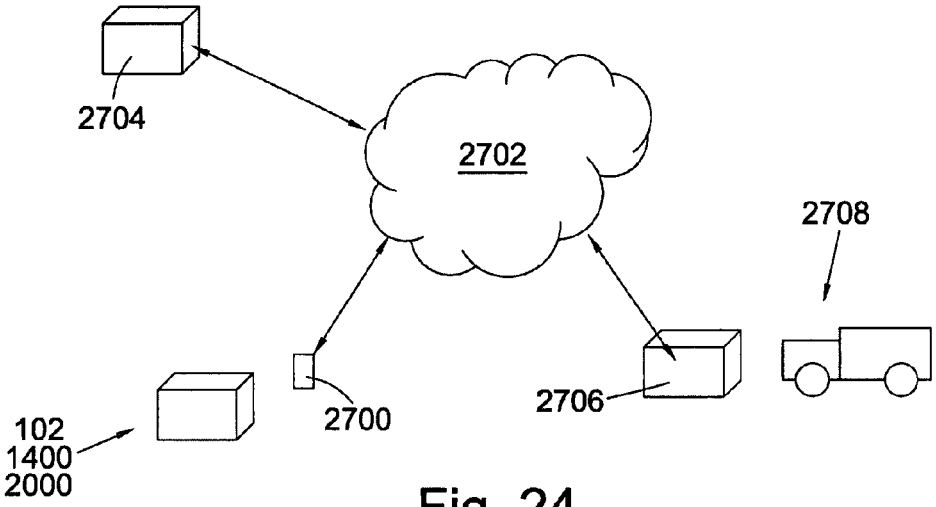
FIG. 24 shows a network structure utilised in an embodiment of the invention.

In the embodiment being described, the identifying mechanism 2500*a,b,c* is a Quick Response Code 2600 (QR code) as exemplified in FIG. 23. The skilled person will appreciate that the QR code is also known as being a 2D barcode. In other embodiments, the identifying mechanism 2500*a-c* may other than the QR code and may for example be a bar code, an RFID tag, the electronic identity of the processing circuitry, or other electronically readable technology.

Each of the devices 102, 1400, 2000 may be modified to have a pocked associated therewith in which a courier packet, or other suitable container, may be stowed.

In use, once the device 102, 1400, 2000 has reached the destination from which it is to be returned 2800, the device 102, 1400, 2000 is deactivated 2802 as described above in relation to each of the device 102, 1400, 2000.

It will be appreciate that during the journey that the device 102, 1400, 2000 has made the processing circuitry therewithin has, from time-to-time, transmitted, using the communication module, the location of the device 102, 1400, 2000 as determined by the position locator. A remote monitoring service receives these signals and tracks the location of the device 102, 1400, 2000 along its journey. Thus, when the device 102, 1400, 2000 is deactivated the monitoring service may already be aware of the location of the device 102, 1400, 2000.

Figure 25:
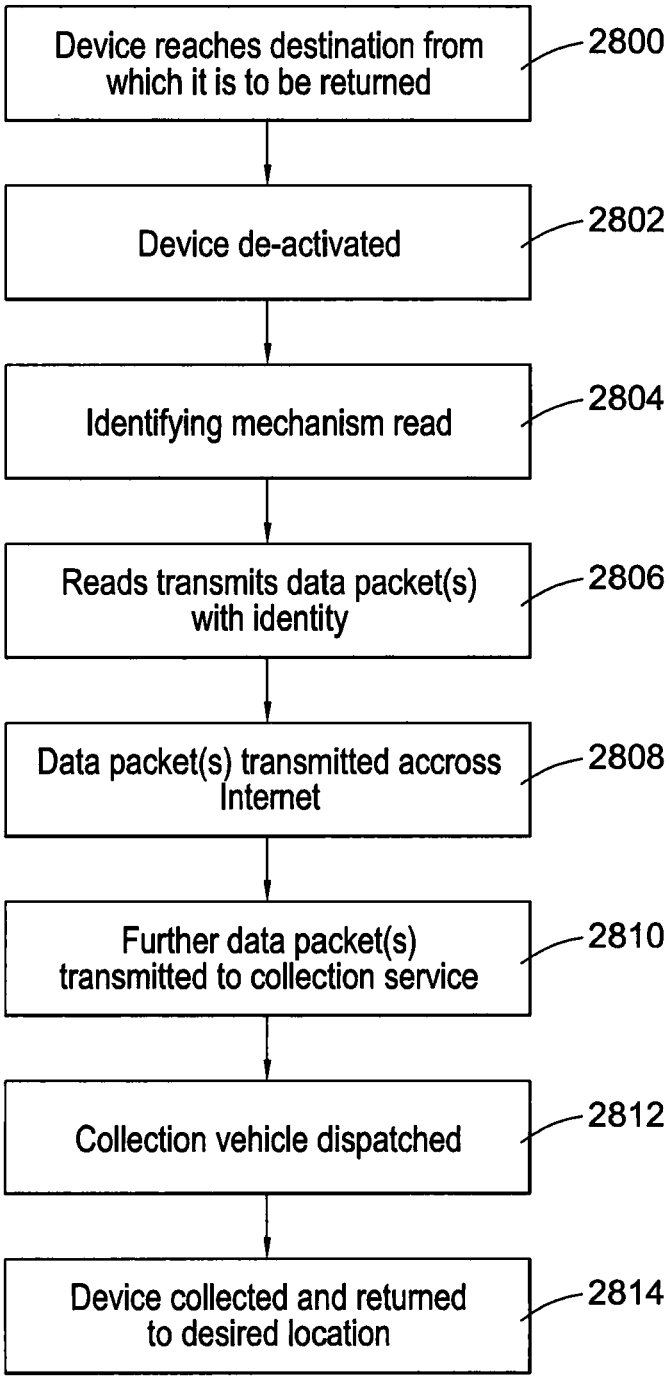
FIG. 25 shows a flow chart outlining the system illustrated with reference to FIGS. 22 to 24.

At the destination location, a reader 2700 is used to read 2804 the identifying mechanism on the device 102, 1400, 2000. Whilst, on the flow chart of FIG. 25, reading of the identifying mechanism is shown after deactivation of the device 102, 1400, 2000, the skilled person will appreciate that this need not be the case and the identifying mechanism 2500*a-c* may be read before or during deactivation of the device 102, 1400, 2000.

In the embodiment being described, the identification mechanism 2500*a-c* provides a unique identity for the device 102, 1400, 2000. In other embodiments the identity provided by the identification mechanism 2500*a-c* may not be unique but may be sufficient to identify the device 102, 1400, 2000 when considered in addition with additional information such as the location of the device 102, 1400, 2000.

The reader 2700 is arranged to transmit one or more data packets which contain the identity read from the identification mechanism 2500*a-c*. The data packet(s) may be transmitted directly from the reader 2700 or may be transmitted at a later time perhaps after the reader 2700 has been docked with another computing device.

In the embodiment being described, the reader may be provided by a smart phone such as an iPhone, a Blackberry or the like and is arranged to transmit the data packet(s) across the Internet 2702. However, in other embodiments, the data packets(s) may be transmitted across any other suitable network which is likely to be Wide Area Network (WAN).

The data packet(s) are transmitted to one or more remote servers 2704. Typically these servers also provide the remote monitoring service used to track the location of the device 102, 1400, 2000. However, in other embodiments the remote server(s) 2704 may simply be in communication with servers providing the monitoring service.

In the embodiment being described, the reader 2700 transmits the data packet(s) onto the Internet via a wireless telecommunications network, such as a GSM or Universal Mobile Telecommunications System (UMTS), 4G or the like. Once the data packet(s) reach the Internet then they are transmitted 2808 to the to the remote server 2704.

In some embodiments, receipt of the data packets(s) by the remote server 2704 may trigger the collection of the device 102, 1400, 2000 but in other embodiments it is possible that the data packet(s) includes further instructions sent from the reader 2700. For example, the further instructions could cause a tracking report to be issued, the location of the device to be sent, a cargo manifest could be sent or the like.

However, in the presently being described embodiment once the remote server 2704 receives the data packet(s) it generates a request for collection of the device 102, 1400, 2000 which is sent 2810 as a further data packet(s) to a server 2706 of a collection service 2708.

The further data packet(s) sent to the server 2706 of the collection service will typically include the location of the device 102, 1400, 2000 but may also provide a mechanism for the server 2706 to look up the location of the device 102, 1400, 2000. However, the collection service will determine the location of the device 102, 1400, 2000 and dispatch 2812 a vehicle to collect the device 102, 1400, 2000.

Once the vehicle has arrived at the location of the device, the device is collected and transmitted a desired location where it can be re-used.

It will be noted that the monitoring device of FIGS. 1 to 10 has a pouch 702 arranged to contain documentation and/or a courier envelope to be used in the reverse logistics described in relation to FIG. 28. The skilled person will appreciate that any of the devices shown in relation to FIGS. 11 through 27 may also contain similar pouches.

The skilled person will appreciate that a number of aspects of the invention have been described above. However, the skilled person will appreciate that there is similarity between these aspects of the invention and will appreciate that features of any one of the aspects may, mutatis mutandis, be utilised in other of the aspects of the invention.

Reference is made herein to the monitoring device 102. In some aspects of the invention, or other embodiments, this element may be referred to as a locking device.

The invention claimed is:

1. A monitoring device arranged to be fitted to a door, wherein the door includes an operating bar mounted on the door for angular movement about its axis and a handle which is connected to the operating bar by a pivotal connection;

wherein the monitoring device comprises a body element and a cover element arranged to slide relative to the body element and the two elements having a closed configuration and an open configuration in which the cover element is extended relative to the body element thereby allowing the monitoring device to be fitted to the operating bar of the door;

the body and cover elements being shaped so that when in the closed configuration a pocket is formed that substantially surrounds the operating bar and further wherein the cover element comprises a portion extending over a region of the handle of the door to which the monitoring device is fitted such that the handle is prevented from rotating relative to the door;

the device further comprises monitoring circuitry arranged to monitor a presence of the operating bar to which in use the monitoring device is fitted; and wherein the monitoring device is arranged to generate an alarm should monitoring circuitry detect a change in the monitored presence of the operating bar.

2. The monitoring device according to claim 1 in which the cover element is captive on the body element so that it cannot be removed therefrom.

3. The monitoring device according to claim 1 in which the monitoring circuit comprises a communication module and wherein the alarm comprises generation of a signal transmitted via the communication module.

4. The monitoring device according to claim 1 in which at least one of the body element and the cover element comprises a U shaped portion arranged to provide a part of the pocket which is arranged to receive the operating bar.

5. The monitoring device according to claim 4 in which both the body element and the cover element comprise a U-shaped portion, each U-shaped portion comprising two arms, and wherein the U shaped portions are arranged, when the monitoring device is in the open configuration, such that the arms of the U shaped portions face one another.

6. The monitoring device according to claim 5 in which, when in the closed configuration, the arms of the U shaped portions come together to form the pocket.

7. The monitoring device according to claim 4 in which the U shaped portion comprises arms, and one of the arms of the U shaped portion of the cover element forms a cover portion of the cover element arranged to overlie the body element when the monitoring device is in the closed configuration.

8. The monitoring device according to claim 1 in which the cover element comprises an opening through which a pin is inserted such that when the pin is inserted the cover element cannot be moved relative to the body element.

9. The monitoring device according to claim 1 in which the body element contains processing circuitry arranged to perform one or more of the following functions: monitor the presence of the operating bar to which the monitoring device is fitted; monitor a presence of an activation pin once the monitoring device has been activated; determine a position of monitoring device; transmit data; transmit the position of the monitoring device; transmit alarms if nefarious activity is detected.

10. The monitoring device according to claim 1 in which the monitoring circuitry is arranged to monitor a relative position of the body and cover elements; and to generate an alarm should the monitoring circuitry detect a change in the relative position.

11. A method of returning the monitoring device according to claim 1 to a location, comprising a) providing the monitoring device with an identifying mechanism;

b) using a reader to read the identifying mechanism associated with the monitoring device and generate one or more datapackets containing an identity of the monitoring device;

c) transmit the datapacket(s) to one or more remote servers d) causing the server to determine the location of the monitoring device for which the datapacket(s) have been received;

e) causing at least the location at which the identity of the monitoring device was read to be transmitted in one or more further datapacket(s), using a communication network, to a collection service;

f) causing the collection service to attend the location determined from the further datapacket(s), collect the monitoring device and return the monitoring device to a predetermined location.

12. The method according to claim 11 in which the identifying mechanism is one of the following: a QR code; a bar-code; an RFID tag.

13. The method according to claim 11 in which the reader is a smartphone.

14. A method of monitoring an operating bar of a door, wherein the operating bar is mounted on the door for angular movement about its axis and the door includes a handle which is connected to the operating bar by a pivotal connection, the method comprising:

fitting a monitoring device to the operating bar of the door, wherein the monitoring device comprises a body element and a cover element arranged to slide relative to the body element, the two elements having a closed configuration and an open configuration in which the cover element is extended relative to the body element thereby allowing the monitoring device to be fitted to the operating bar of the door, the body and cover elements being shaped so that when in the closed configuration a pocket is formed that substantially surrounds the operating bar and further wherein the cover element comprises a portion extending over a region of the handle of the door to which the monitoring device is fitted such that the handle is prevented from rotating relative to the door;

monitoring, by monitoring circuitry included in the monitoring device, a presence of the operating bar to which in use the monitoring device is fitted; and generating, by the monitoring device, an alarm should the monitoring circuitry detect a change in the monitored presence of the operating bar.

* * * * *